United States Patent [19]

Chen

[11] Patent Number: 4,864,087

[45] Date of Patent: Sep. 5, 1989

[54] BURGLAR ALARM INCLUDING A REED RELAY ACTUATED IN RESPONSE TO A VIBRATING MAGNET TO PRODUCE AN ALARM SIGNAL

[76] Inventor: Yu-Hua Chen, No. 5, Lane 32, Fu Hsing 2nd Road, Peitou District, Taipei, Taiwan

[21] Appl. No.: 133,229

[22] Filed: Dec. 14, 1987

[51] Int. Cl.[4] ..... H01H 3/02

[52] U.S. Cl. ..... 200/61.93; 200/61.84; 335/205; 340/545

[58] Field of Search ..... 335/205; 200/52 R, 61.71, 200/61.84, 61.93, 61.45 M; 340/545, 547, 550, 565, 566, 567, 571

[56] References Cited

U.S. PATENT DOCUMENTS

| | | | |
|---|---|---|---|
| 3,193,198 | 7/1965 | Carlson | 335/205 |
| 4,438,430 | 3/1984 | Young et al. | 200/61.62 |
| 4,710,646 | 12/1987 | Curda et al. | 200/61.18 |

*Primary Examiner*—A. D. Pellinen
*Assistant Examiner*—Morris Ginsburg
*Attorney, Agent, or Firm*—Browdy and Neimark

[57] ABSTRACT

The present disclosure is directed to an improved burglar alarm which is mounted on a base having a concaved space for receiving therein a ring-like magnet with an elongated resilient arm, vibratable as a result of external force, and a magnetic switch tube actuated in response to the vibrating magnet which changes either the magnet polarity or intensity of the magnetic force thereof so to produce signals to actuate a connected alarm apparatus.

2 Claims, 3 Drawing Sheets

BURGLAR ALARM INCLUDING A REED RELAY ACTUATED IN RESPONSE TO A VIBRATING MAGNET TO PRODUCE AN ALARM SIGNAL

BACKGROUND OF THE INVENTION

1. Field of the Invention

The present invention relates to an improved burglar alarm consisting of a base having peripherally disposed side wall thereon, forming a concave space for receiving a ring-like magnet which has an extended resilient arm fixed at one end, permitting reciprocating vibration on being actuated by external force, and a reed relay located through the central opening of the ring-like magnet, which is effected by the vibrating magnet so to actuate an alarm apparatus for producing warning signals to the security people or the like. The present alarm device is characterized in its sensitive, reliable and simple structure, free of the external sabotage by magnetic force.

2. Prior Art

There are two most prevailing burglar alarms available on the market, the first one adopts the "reed relay", and the second one uses "vibration detecting means". The first type of device consists of a magnet 421A and a reed relay 41A which is provided with separable magnetic contact points 411A. In practical use, the reed relay 41A is mounted on the frame of a window and connected to an alarm device, and the magnet 421A in case 42A is fixed on the movable window, so the distance between the magnet and relay is varied when the window is pushed opened, resulting in the reduction of the magnetic force therebetween. This causes the contact points 411A of the reed relay 41A come into contact (as shown in FIG. 7 and FIG. 8), and a signal is accordingly produced to actuate an alarm.

The disadvantage of this type of device lies in that when the burglar breaks the window instead of pushing it open, this type of alarm device becomes useless in detecting the breaking-in of the burglar. Therefore, another complementary device which can be actuated by vibration must be mounted on the window glass whereby the breaking of the window will be detected. This type of so called "vibration detecting" device falls in three categories, including a mercury type, counter weight type, and sound actuation type. The operation modes of the three above cited devices are described as below.

1. The mercury type device consists of a sealed glass tube 14A in which short a long metal legs 11A, 12A are parallelly disposed, the tube being connected externally to an alarm device and housed in a shelter case 1A as shown from FIG. 1 to FIG. 3. The external stimulation on the tube will make the fluid mercury 13A move back and forth so to electrically connect the two legs, thus making the alarm device operate accordingly.

2. The counter weight type device has an elongated spring plate 23A, one end of which is fixed on the case 21A and the other end of which is free to move up and down. A counter weight 24A is attached to the free end so to enable the free end to vertically vibrate in a large scale and reciprocatingly contact the point 25A as shown in FIG. 4 and FIG. 5, thereby producing "open and close" signals. Element 22A is an adjusting screw which determines the vibration condition of the counter weight.

3. The sound actuation type adopts a sound detecting device 31A such as a piezoelectric buzzer or a microphone, which is fixed on a protected body; and the sound produced by the impact on the protected body by foreign object will stimulate the sound detecting device and the signal is transmitted to a frequency amplifying transformer 32A to produce an actuation signal.

The disadvantages inherent in the above cited three vibration detecting devices are listed as follows.

1. The mercury type device uses fluid mercury which is not able to be controllably adjusted and is apt to be mistakingly actuated.

2. The counter weight type device has its two contact points constantly exposed to the air and is easily oxidized thereby, causing malfunction accordingly.

3. The sound actuation type needs extra equipment to amplify the produced signals, so the price is higher.

SUMMARY OF THE INVENTION

The primary object of the present invention is to provide an improved burglar alarm which uses a ring-like magnet attached to one end of an elongated resilient arm with a reed relay going therethrough, combining the features of both the magnetic switch tube and the vibration detecting device in the present invention.

One further object of the present invention is to provide a simply structured, reasonably priced, and effectively operated burglar alarm device which eliminates all the existing problems in the conventional arts.

DETAILED DESCRIPTION OF THE PREFERRED EMBODIMENTS

Figure 9:
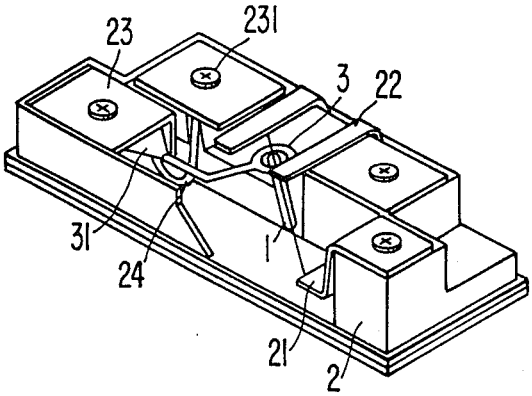
FIG. 9 is a diagram showing the structure of the first type of the present invention.

Referring first to FIG. 9, the present invention adopts a reed relay 1, disposed obliquely at an angle of 45 degrees, one end of which is fixed under one end of a Zshaped copper member 21, and the other end of which is coupled to a horizontally disposed U-shaped copper member 22. A ring-like magnet plate 3 passes over to one end of the reed relay 1 with the relay 1 going through the central hole of the magnet plate 3 and the relay 1 is orthogonal with respect to the plate 3. A resilient arm 31 is attached at one end with the magnetic plate 3 with the other end of the resilient arm 31 secured to the underside of an inverted L-shaped copper plate 23 by a screw 231, and the inverted L-shaped plate 23 is disposed at the left side of a 2. An approximately U-shaped copper plate 24 is fixed with one end, to the screw 231 and the other in abutment with the underside of the resilient arm 31 so that by adjusting the screw 231, the tension on the resilient arm 31 can be accordingly changed.

Figure 10A:
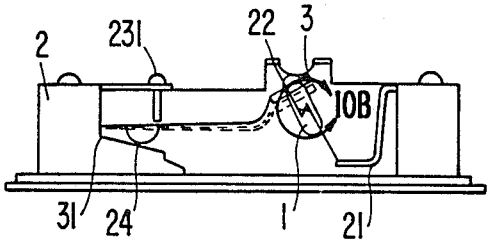
FIG. 10A is a sectional view of FIG. 9.
Figure 10B:
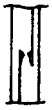
FIG. 10B is an exploded view of the circle portion of FIG. 10A.
Figure 13:
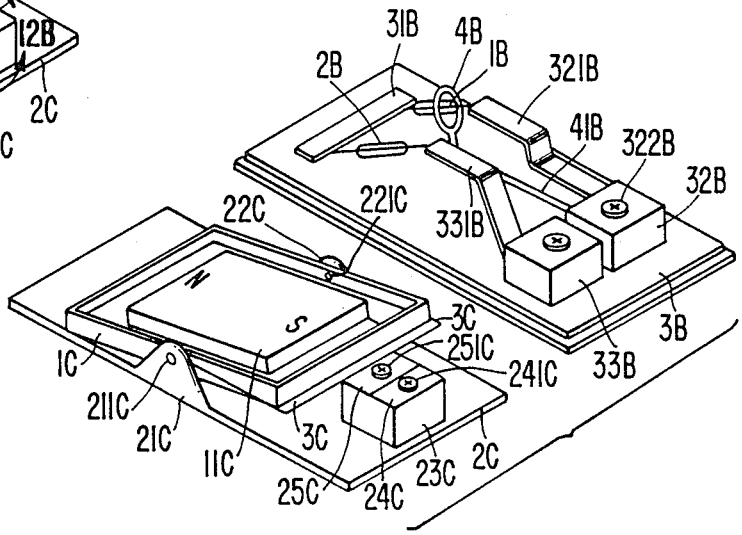
FIG. 13 is a diagram showing the relation of the dual-tube device and the magnet mount in assembly.
Figure 14:
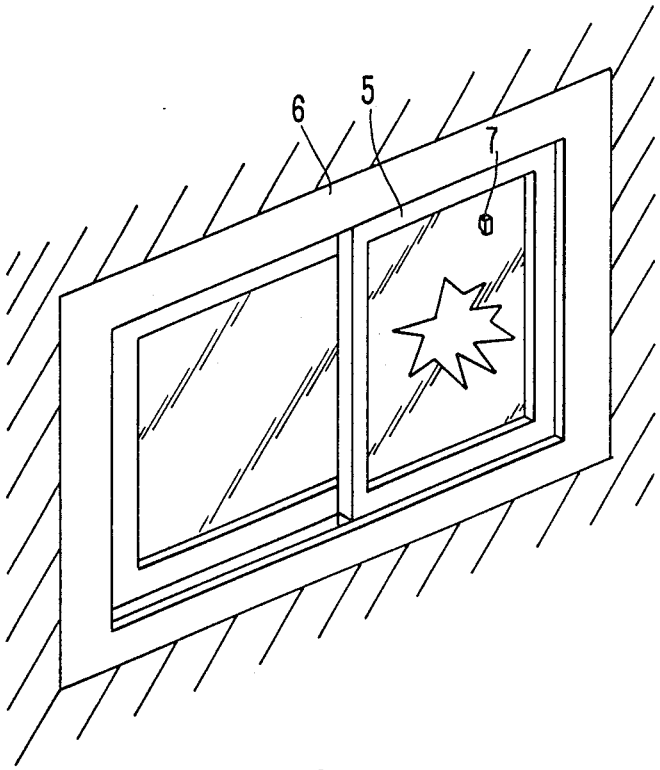
FIG. 14 is a diagram showing the application of the first type of the present invention.

As further shown in FIGS. 10A and 10B, when the device of the present invention is actuated by external force, the resilient arm 31 as well as the magnet 3 is affected. The ring-like magnet plate 3 begins to vibrate, and the range of the vibration is limited by the U-shaped copper member 22. The two contacting legs of the reed relay 1 are affected so to periodically come into connection and disconnection accordingly, and the so produced signal are output to actuate an external alarm device. As preceedingly recited, the screw 231 is used to adjust the tension between the resilient arm 31 and the U-shaped copper plate so to vary the sensitivity therebetween in operation. As shown in FIG. 14, if reed relay 1 is mounted on the window glass, the breaking thereof can actuate the relay accordingly.

Figure 1:
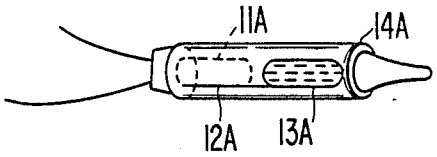
FIG. 1. (PRIOR ART)
FIG. 1 is a perspective view of the conventional mercury type device.
Figure 2:
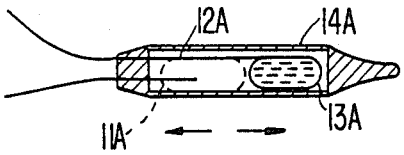
FIG. 2. (PRIOR ART)
FIG. 2 is a sectional view of FIG. 1.
Figure 3:
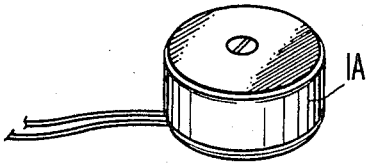
FIG. 3. (PRIOR ART)
FIG. 3 is a diagram showing the shelter case for the mercury type device.
Figure 4:
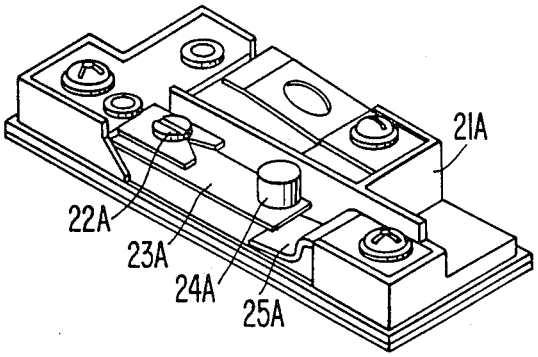
FIG. 4. (PRIOR ART)
FIG. 4 is a diagram showing the conventional counterweight type device.
Figure 5:
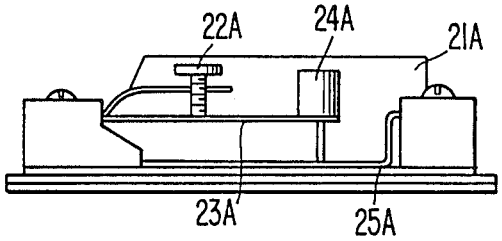
FIG. 5. (PRIOR ART)
FIG. 5 is a sectional view of FIG. 4.
Figure 6:
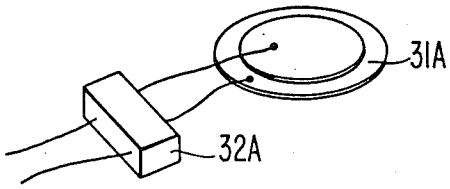
FIG. 6. (PRIOR ART)
FIG. 6 is a diagram showing the conventional sound actuation device.
Figure 8:
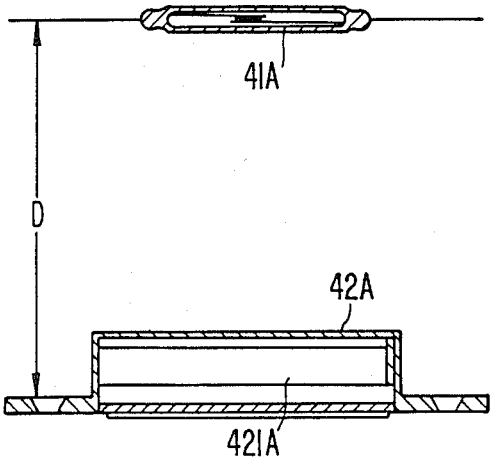
FIG. 8. (PRIOR ART)
FIG. 8 is a diagram showing the reed relay in an operative state.
Figure 7:
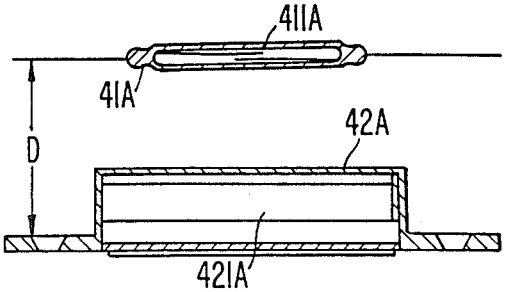
FIG. 7. (PRIOR ART)
FIG. 7 is a diagram showing the reed relay in a non-operative state.
Figure 11:
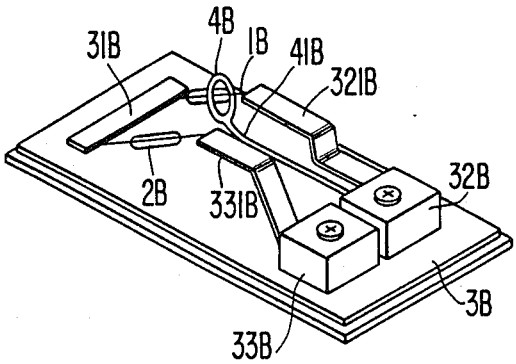
FIG. 11 is a dual-tube device for the second type of the present invention.
Figure 12B:
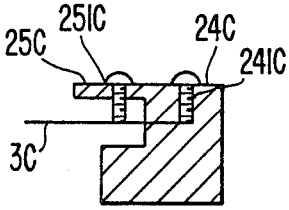
FIG. 12B is an exploded view of the circled portion of FIG 12A.
Figure 12A:
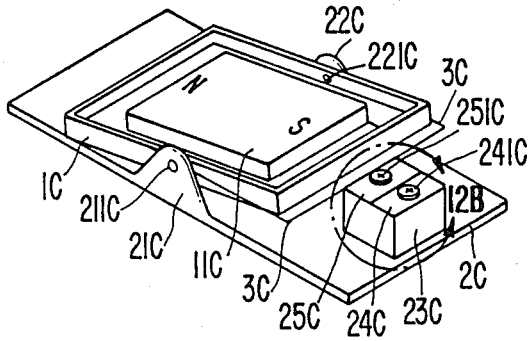
FIG. 12A is a magnet mount used in combination with the dual tube device of FIG. 11.

Referring further to FIGS. 11, 12A and 12B, another type of application of the present invention, in conjunction with one improved prior art, is shown. The two components shown in FIG. 11 and 12 are disposed side by side in actual operation. The dual-relay device in FIG. 11 includes a pair of parallel relays 1B, 2B obliquely disposed at an angle of 45 degrees with one end of these relays fixed to an oblong copper plate 31B which is attached at one side of a rectangular board 3B. A pair of blocks 32B, 33B are disposed at the other side thereof. A resilient arm 41B outwardly extends at the center of the block 32B, and a ring-like magnet 4B is associated with the reed relay 1B is such a manner that the two are orthogonally located wtih respect to each other with the relay 1B going through the central hole of the ring-like magnet 4B.

An approximately Z-shaped copper plate 321B is fixed to the top portion of the block 32B, the free end of which is coupled to the non-fixed end of the reed relay 1B. Said copper plate 321B as well as said resilient arm 41B is fixed to the block 32B by means of a screw 322B. Another Z-shaped copper plate 331B is identically associated with the reed relay 2B, and the two parallel relays 1B, 2B are electrically connected in series.

As further shown in FIG. 12A, a magnet mount consists of a base board 2C having a pair of symmetric lugs 21C, 22C disposed at each center of the two parallel sides thereof. One each of the lugs 21C, 22C, there is disposed a bore 211C and 221C respectively for the disposition of a bracket 1C in a see-saw manner, a rectangular magnet 11C is fixed by glue to the bottom of the bracket 1C. A wire spring 3C is disposed along the right half of the periphery of the bracket 1C and having its two ends fixed to the lugs 21C, 22C, with the central portion of the wire spring 3C extending outwardly and fixed by screws 241C, 251C respectively on a block 23C with a copper members 24C, 25C disposed between said screws 241C, 251C and the outwardly extended central portion. Thus, by adjusting, that is turning the screws 241C, 251C, the tension on the wire spring 3C can be accordingly changed so to alter the extent of the force required to actuate the bracket 1C in operation.

As shown in FIG. 14, the first type of the improved burglar alarm 7 according to the present invention is mounted on the glass of the window, and is actuated when the glass is broken by any invader.

Figure 15:
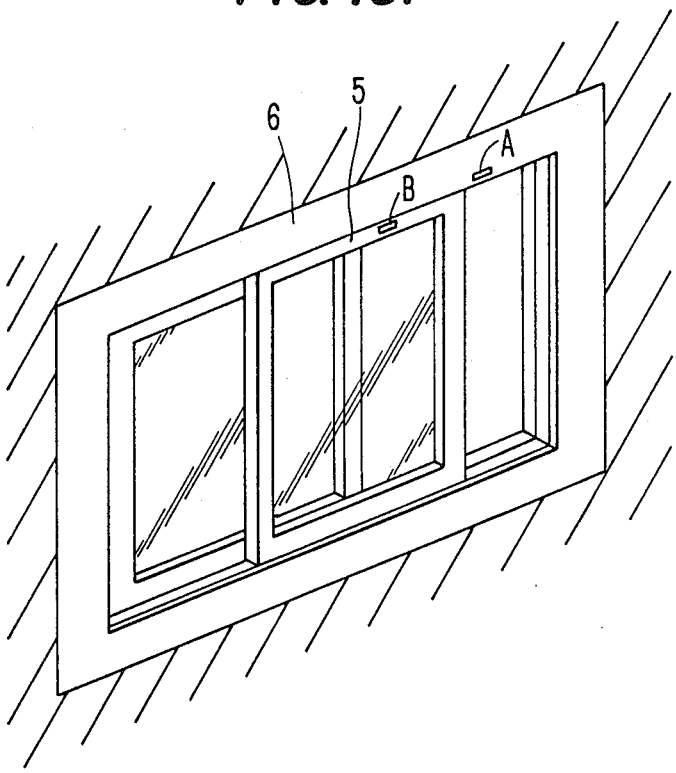
FIG. 15 is a diagram showing the application of the second type of the present invention.

In another application, the magnet mount of the second type of the present burglar alarm is attached on a movable window frame 5, and the dual-relay device is moutned on a fixed frame 6 as shown in FIG. 15 with the two devices A, B disposed at an operative distance, side by side, when the window is closed, so that the opening push of the window resulting in the change of the magnetic condition therebetween, thus causing the reed relay to function accordingly. in case of the window being broken, the dual-relay type device can also be actuated; and the use of an external magnetic force to affect the operation of the dual-relay type device can also be prevented as a result of the adoption of the see-saw type magnet mount.

What I claimed is:

1. An improved burglar alarm, comprising:

a rectangular base, a ring-like magnet with an elongated resilient arm, a reed relay, wherein said base has an upright side wall around a substantial portion of the periphery thereof with a Z-shaped copper plate disposed at a right end and an inverted L-shaped copper plate located at a left end thereof, and a U-shaped copper plate horizontally disposed over a central portion of said base; one end of said reed relay being coupled to said Z-shaped copper plate, and the other end thereof being connected to one leg of said U-shaped copper plate; said reed relay being obliquely disposed at an angle of approximately 45 degrees with respect to said base with said ring-like magnet substantially orthogonally associated therewith at a front end thereof, said resilient arm being connected to said inverted L-shaped copper plate disposed at a left side of said base by means of a screw.

2. An improved burglar alarm, comprising a base, a pair of parallelly disposed reed relays, a ring-like magnet having a resilient arm extending therefrom, a magnet mount and a rectangular magnet, wherein said base has two blocks disposed at a right side thereof and an oblong copper plate disposed at a left side thereof, and said pair of reed relays being respectively coupled to said oblong copper plate at one end and located obliquely with respect to said base at an angle of approximately 45 degrees, and the other end of said relays being respectively connected to Z-shaped copper plates, said ring-like magnet having a central hole disposed around one end of said parallel relays and disposed substantially orthogonally with respect thereto; a pair of lugs being disposed on each side of said magnet mount, said lugs being provided with a respective bore thereon so to pivotally mount a bracket on which said rectangular magnet is fixed; a wire spring being fixed with its two ends to said lugs and the rest thereof disposed alongside a right periphery of said bracket, and a central portion of said wire spring being outwardly extended and fixed by a pair of screws on an upright block so that by adjusting said screws, the tension on said wire spring can be increased or alleviated.

* * * * *